United States Patent [19]

Saad

[11] Patent Number: 4,673,903

[45] Date of Patent: Jun. 16, 1987

[54] EVANESCENT MODE TRIPLE RIDGE LOWPASS HARMONIC FILTER

[75] Inventor: Abdelmegid K. Saad, Cambridge, Canada

[73] Assignee: Com Dev Ltd., Cambridge, Canada

[21] Appl. No.: 667,824

[22] Filed: Nov. 2, 1984

[30] Foreign Application Priority Data

May 28, 1984 [CA] Canada ..... 455285

[51] Int. Cl.[4] ..... H01P 1/211

[52] U.S. Cl. ..... 333/210; 333/248

[58] Field of Search ..... 333/210, 211, 212, 209, 333/208, 202, 227, 248

[56] References Cited

U.S. PATENT DOCUMENTS

| | | | |
|---|---|---|---|
| 2,785,381 | 3/1957 | Brown | 333/208 |
| 3,046,503 | 7/1962 | Vohn | 333/210 |
| 3,271,706 | 9/1966 | Rooney | 333/210 |

FOREIGN PATENT DOCUMENTS

| | | | |
|---|---|---|---|
| 0024057 | 2/1977 | Japan | 333/208 |

OTHER PUBLICATIONS

Young et al., "New & Improved Types of Waffle Iron Filters", *Proc. IEEE*, vol. 110, No. 7, Jul. 1963, pp. 1191–1198.

*Primary Examiner*—Eugene R. LaRoche
*Assistant Examiner*—Benny T. Lee
*Attorney, Agent, or Firm*—Daryl W. Schnurr

[57] ABSTRACT

A waveguide lowpass filter has successive groups of three separate ridges spaced longitudinally in said filter. A center ridge of each filter has a larger cross-sectional area than two side ridges which are the same size. All ridges are parallel to one another in a longitudinal direction. The groups are associated with shunt capacitances and the spaces between adjacent groups are associated with series inductances in an evanescent mode. In operation, the filter is capable of supporting a $TE_{10}$ mode in the passband and three modes, $TE_{10}$, $TE_{20}$ and $TE_{30}$ in the stopband. The filter has a relatively high power handling capability as compared to previous evanescent mode lowpass harmonic filters.

8 Claims, 7 Drawing Figures

FIGURE 2
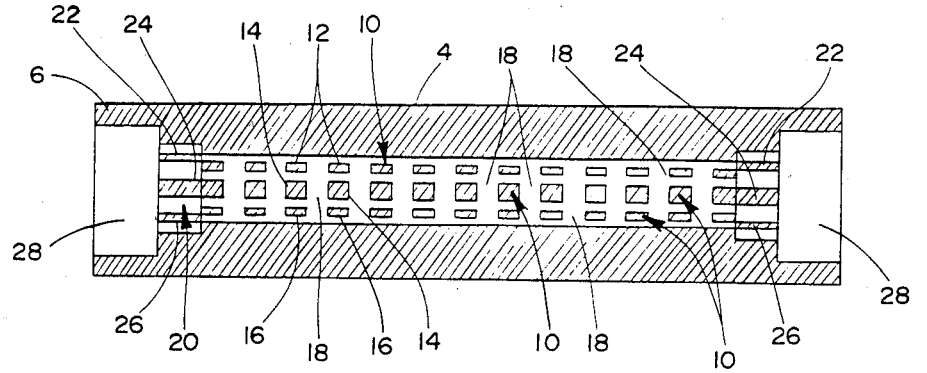
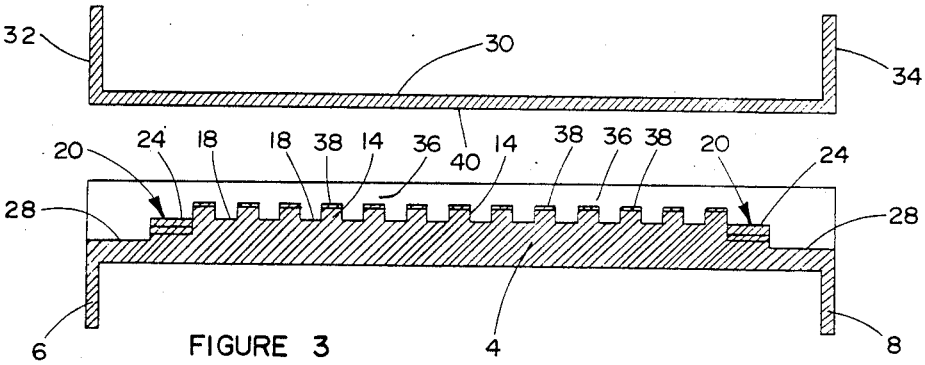
FIGURE 3
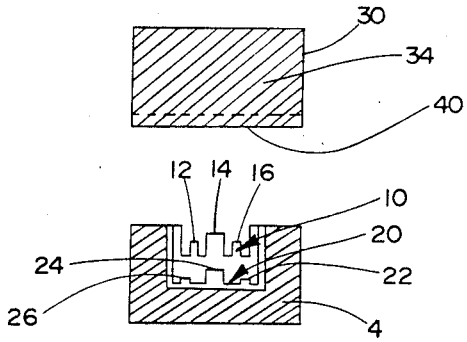
FIGURE 4

EVANESCENT MODE TRIPLE RIDGE LOWPASS HARMONIC FILTER

BACKGROUND OF THE INVENTION

1. Field of the Invention

This invention relates to a lowpass harmonic filter of the type used in output circuits of communications satellites. In particular, this invention relates to a waveguide lowpass filter that is capable of supporting three modes in a stopband.

2. Description of the Prior Art

Lowpass harmonic filters are used to augment isolation over a receive band of the filter and provide high attenuation for second and third harmonics of high level TWTAs.

As the number of satellites and frequency bands increases, it is becoming necessary to provide high isolation all the way from the receive band to the third harmonic in order to control spurious emission and to minimize interference with other satellite systems. It is known to have lowpass harmonic filters as discussed in a paper entitled "Tapered Corrugated Waveguide Low Pass Filters", by R. Levy, published in Institute of Electrical and Electronics Engineers Transaction on Microwave Theory and Technics, MTT-21, No. 8, dated August, 1973, pp. 526–532. These previous filters require low impedance sections in order to minimize spurious responses. Also, these filters have a relatively low power handling capability and can be relatively complex to fabricate and therefore expensive.

A waveguide lowpass filter having a single or double ridge structure is described in U.S. Pat. No. 3,949,327 dated April, 1976 and naming H. F. Chappell as inventor. This previous filter is capable of achieving a higher filter impedance than the corrugated waveguide structures but can only support one mode in both the passband and the stopband. The power handling capability of the filter described by Chappell is therefore relatively low in a vacuum environment.

SUMMARY OF THE INVENTION

It is an object of the present invention to provide a lowpass filter that is capable of supporting one mode in a passband and three modes in a stopband.

It is a further object of the present invention to provide a lowpass filter that has a relatively high power handling capability in vacuum and can provide spurious free response up to at least a third harmonic.

A waveguide lowpass filter in accordance with the present invention has a filter body with successive groups of three separate ridges formed therein, said groups being spaced longitudinally in said filter with spaces therebetween. All ridges are parallel to one another in a longitudinal direction. The groups are associated with shunt capacitances and the spaces between successive groups are associated with series inductances in an evanescent mode. Each group has one centre ridge and two side ridges disposed transversely across said filter, with said side ridges being equally spaced from said centre ridge. The side ridges are smaller in width than the centre ridge. The filter is capable of supporting one mode in the passband and three modes in the stopband.

Preferably, the side ridges are identical to one another and are smaller in height than the centre ridge.

BRIEF DESCRIPTION OF THE DRAWINGS

In drawings which illustrate a preferred embodiment of the invention:

FIG. 2 is a top view of a filter in accordance with the present invention with the cover removed;

FIG. 3 is a side view of a filter of the present invention with a cover shown in a detached position;

FIG. 4 is an end view of a filter and cover of FIG. 3;

FIG. 5(*b*) is a measured out-of-band response for said filter; and

DESCRIPTION OF A PREFERRED EMBODIMENT

Figure 1:
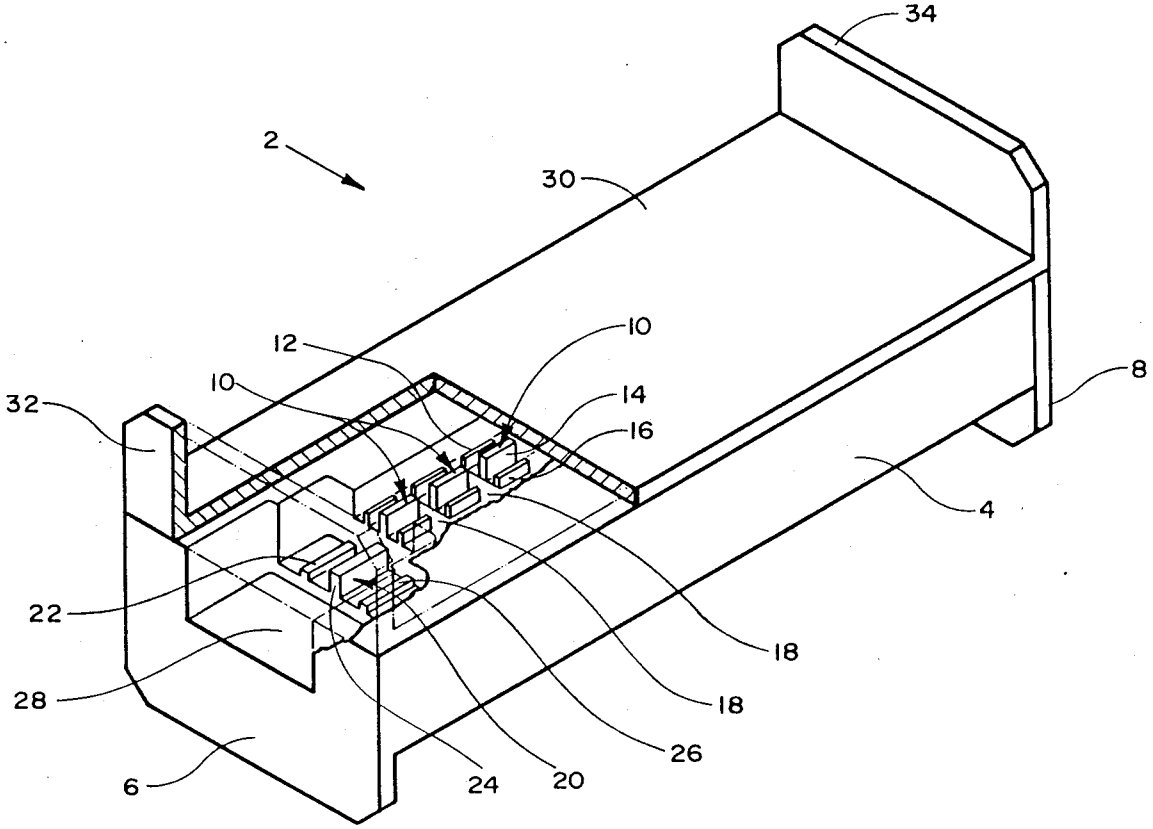
FIG. 1 is a perspective view of a filter of the present invention with part of a cover and part of an end of said filter being removed for ease of illustration.

Referring to the drawings in greater detail, in FIG. 1, a filter 2 has a filter body 4 with end sections 6, 8. The filter body 4 contains successive groups 10 of three separate ridges 12, 14, 16 spaced longitudinally throughout said filter 2 between end sections 6, 8. Spaces 18 are located between successive groups 10.

All ridges 12, 14, 16 are parallel to one another in a longitudinal direction. Each group of ridges has one centre ridge 14 and two side ridges 12, 16 disposed transversely across said filter 2. The side ridges 12, 16 are smaller in width than the centre ridge 14. The ridges 12, 14, 16 have a rectangular cross-section and the centre ridge 14 has a larger cross-sectional area than the side ridges 12, 16. The side ridges 12, 16, also referred to as auxiliary ridges, are the same size. The side ridges 12, 16 are equally spaced from the centre ridge 14.

Transformers 20 having ridges 22, 24, 26 are located at either end 6, 8 of the filter body 4. A section 28 located at each end of sections 6, 8, is an interface waveguide system that can be used as single or triple ridge transformer sections, if necessary. A cover 30 for the filter body 4 has end sections 32, 34. The arrangement of the groups 10, spaces 18 and transformers 20 can best be seen in FIGS. 2, 3 and 4.

In operation, the groups 10 are associated with shunt capacitances and the gaps 18 are associated with series inductances in an evanescent mode. The triple ridge waveguide sections or groups 10 are designed to support only one mode, $TE_{10}$ in a passband and three modes, $TE_{10}$, $TE_{20}$ and $TE_{30}$, in a stopband. This results in an increase in the size of gaps 36, between a top surface 38 of each ridge 14 and interior surface 40 of the cover 30, to nearly twice the size of the gap that is used in a double ridge filter in accordance with the Chappell patent referred to above. The electric field is distributed between the three ridges 12, 14, 16 of each group 10. The side ridges 12, 16 also serve to control the cut-off frequency of the higher order modes $TE_{20}$ and $TE_{30}$ to be outside of the passband of the filter and also outside of the relevant stopband. When a $TE_{20}$ mode begins to propagate, it is suppressed by the auxiliary ridges 12, 16. When a $TE_{30}$ mode begins to propagate, it is suppressed by the centre ridge 14 and the auxiliary ridges 12, 16 together. It is possible to design the filter 2 to control the degree of suppression of spurious modes.

Figure 5A:
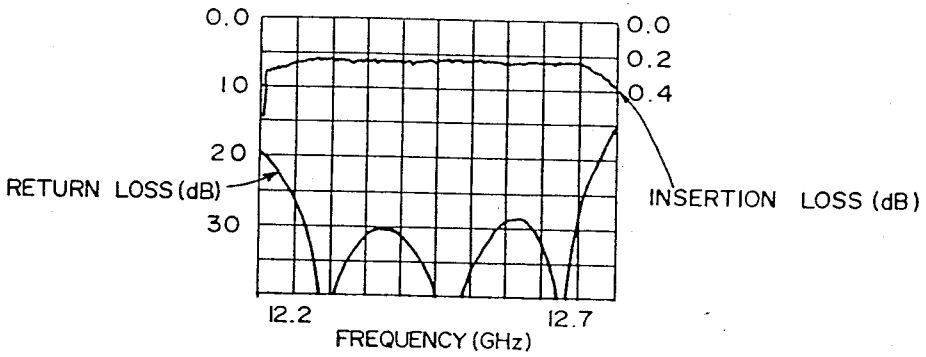
FIG. 5(*a*) is a measured passband response for said filter.
Figure 5B:
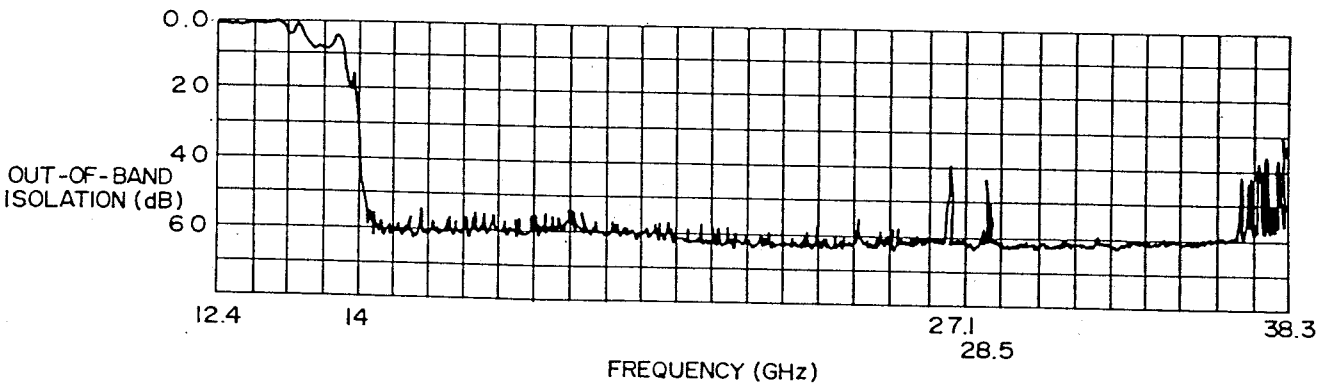

In FIG. 5(*a*), there is shown the return loss and insertion loss in the passband. It can be seen that the return loss is greater than 26 dB and the insertion loss is less than 0.25 dB.

In FIG. 5(*b*), there is shown the isolation for the stopband. It can be seen that there is a narrow spike of 35 dB at 27.1 and also at 28.5 GHz. The level of these spikes can be controlled by design, if necessary.

Figure 6:
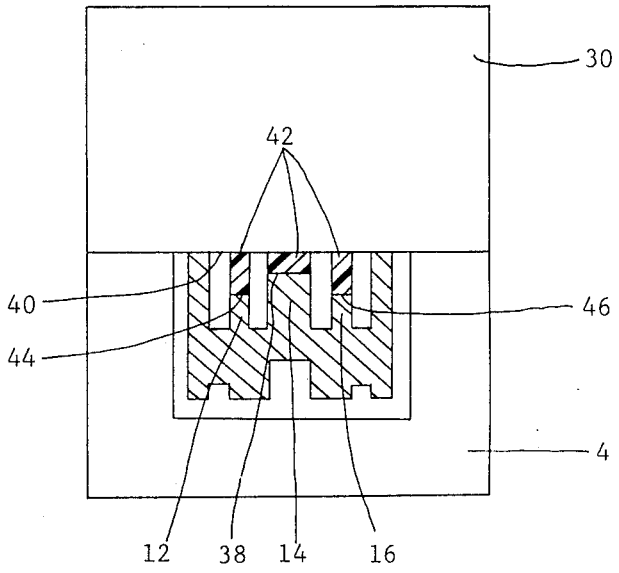
FIG. 6 is an end view of the filter of FIG. 1 with the ridges being top-loaded with dielectric material.

In FIG. 6, there is shown an end view of a filter 2 with the ridges 12, 14, 16 being top-loaded with dielectric material 42 between a top surface 44, 38, 46 of each ridge 12, 14, 16 respectively and an interior surface 40 of the cover 30. Alternatively, the dielectric material 42 could be top-loaded only between a top surface 38 of the centre ridges 14 and an interior surface 40 of the cover 30.

The triple ridge filters in accordance with the present invention are designed in accordance with the following formula wherein the series inductance is equal to $jX_0 \sinh(\gamma l)$ where:

$$\gamma = \frac{2\pi}{\lambda}\sqrt{\frac{\lambda^2}{\lambda_c^2} - 1} \text{ and}$$

$$X_0 = 120\pi\left(\frac{2b}{a}\right) \times \sqrt{\frac{\lambda^2}{\lambda_c^2} - 1}$$

where:

a is the broad wall dimension of the evanescent mode waveguide b is the narrow wall dimension of the evanescent mode waveguide $\lambda$ is the free space wavelength $\lambda_c$ is the cut-off wavelength $= 2a$ l is the distance between two adjacent groups of ridges.

In the following table, the performance of a tapered corrugated waveguide filter, a filter designed in accordance with the teachings of the Chappell patent and a filter of the present invention are compared. It can be seen that the filter of the present invention performs very well when compared to the two prior art filters. The filter of the present invention has a power handling capability in excess of 800 watts in vacuum. The power handling capability of the filter designed in accordance with the teachings of the Chappell patent has a power handling capability slightly in excess of 250 watts and the corrugated filter has a power handling capability slightly in excess of 200 watts.

A filter can be designed in accordance with the present invention with element values selected from either a Chebyshev or a Zolotarev function prototype.

TABLE 1

MEASURED PERFORMANCE COMPARISON OF FILTER OF THE PRESENT INVENTION WITH PRIOR ART FILTERS

| Parameter | Tapered Corrugated Waveguide Filter | Single Ridge Filter In Accordance With Chappell Patent | Triple Ridge Filter In Accordance With Present Invention |
|---|---|---|---|
| Response Function | Zolotarev or Chebyshev | Zolotarev or Chebyshev | Zolotarev or Chebyshev |
| Passband, GHz | 11.7–12.2 | 11.7–12.2 | 12.2–12.7 |
| Return Loss, dB | >26 | >26 | >26 |
| Insertion Loss, dB | <.25 | <.2 | <.25 |
| Rejection, dB | | | |
| 14.0–14.5 GHz | >55 | 60 | 60 |
| 14.5–23.4 GHz | >20 | 60 | >65 |
| 23.4–24.4 GHz | >70 | 80 | >65 |
| 24.4–35.1 GHz | >20 | 60 | >65 |
| 35.1–36.6 GHz | >70 | 80 | >65 |
| Power Handling Capability in Vacuum, W | >200 | >250 | >800 |
| Size | 3.5" × 1.5" × 1.5" | 3.5" × 1.5" × 1.5" | 4.5" × 1.5" × 1.5" |
| Weight, g | 60 | 55 | 75 |

What I claim as my invention is:

1. A waveguide lowpass filter comprising a filter body with successive groups of three separate ridges formed therein, said groups being spaced longitudinally throughout said filter with spaces there between, all ridges being parallel to one another in a longitudinal direction, said groups being associated with shunt capacitances in a passband and stopband, said spaces between successive groups being associated with series inductances in an evanescent mode in the passband, each group having one centre ridge and two side ridges disposed transversely across said filter, with said side ridges being equally spaced from said centre ridge, said side ridges being smaller in width than said centre ridge, said filter being capable of supporting one mode in the passband and three modes in the stopband.

2. A filter as claimed in claim 3 wherein the one mode in the passband is $TE_{10}$ and the three modes in the stopband are $TE_{10}$, $TE_{20}$ and $TE_{30}$.

3. A filter as claimed in claim 1 wherein said side ridges are identical to one another and are smaller in height than said centre ridges.

4. A filter as claimed in any one of claims 1, 3 or 2 wherein the centre ridges are top loaded with dielectric material between a top surface of each of said ridges and an interior surface of a cover for said filter.

5. A filter as claimed in any one of claims 1, 3 or 2 wherein all of the ridges are to loaded with dielectric material between a top surface of said ridges and an interior surface of a cover for said filter.

6. A filter as claimed in any one of claims 1, 3 or 2 wherein the series inductance $= jX_o \sinh(\gamma l)$ where $$\gamma = \frac{2\pi}{\lambda}\sqrt{\frac{\lambda^2}{\lambda_c^2} - 1} \text{ and}$$

$$X_o = 120\pi\left(\frac{2b}{a}\right)\sqrt{\frac{\lambda^2}{\lambda_c^2} - 1}$$

where:

a is the broad wall dimension of the evanescent mode waveguide b is the narrow wall dimension of the evanescent mode waveguide $\lambda$ is the free space wavelength $\lambda_c$ is the cut-off wavelength $=2a$ l is the distance between two adjacent groups of ridges.

7. A filter as claimed in any one of claims 1, 3 or 2 where the element values are selected from a Zolotarev function prototype.

8. A filter as claimed in any one of claims 1, 3 or 2 where the element values are selected from a Chebyshev function prototype.

* * * * *